US007448895B1

(12) United States Patent
Linan

(10) Patent No.: US 7,448,895 B1
(45) Date of Patent: Nov. 11, 2008

(54) COMPRESSION RING FOR A COAXIAL CABLE CONNECTOR

(76) Inventor: Gan Linan, No. 18 Xinghua Rd East, Ronggui, Shunde 528306, Guangdong (CN)

( * ) Notice: Subject to any disclaimer, the term of this patent is extended or adjusted under 35 U.S.C. 154(b) by 0 days.

(21) Appl. No.: 11/865,082

(22) Filed: Oct. 1, 2007

Related U.S. Application Data

(60) Provisional application No. 60/931,510, filed on May 22, 2007.

(51) Int. Cl.
*H01R 13/52* (2006.01)

(52) U.S. Cl. ..... 439/271; 439/584; 439/585

(58) Field of Classification Search ..... 439/271, 439/578, 584, 585
See application file for complete search history.

(56) References Cited

U.S. PATENT DOCUMENTS 4,755,152 A * 7/1988 Elliot et al. ..... 439/452
5,340,332 A * 8/1994 Nakajima et al. ..... 439/584
6,848,940 B2 * 2/2005 Montena ..... 439/584
7,018,235 B1 * 3/2006 Burris et al. ..... 439/584
7,329,149 B2 * 2/2008 Montena ..... 439/584
7,331,820 B2 * 2/2008 Burris et al. ..... 439/578

* cited by examiner

*Primary Examiner*—Tho D Ta
(74) *Attorney, Agent, or Firm*—Laura Tunnell; Michael Petit

(57) ABSTRACT

A compression connector for a coaxial cable wherein an elastically deformable gasket is disposed inside the compression connector to provide a barrier to moisture ingress. The gasket is disposed within a cylindrical axial cavity in the trailing end of the connector body such that when the leading end of the coaxial cable is advanced into the cylindrical axial cavity, the leading edge of the coaxial cable compresses the gasket to effect a moisture seal between the cable and the wall of the axial cavity.

6 Claims, 1 Drawing Sheet

COMPRESSION RING FOR A COAXIAL CABLE CONNECTOR

BACKGROUND OF THE INVENTION

1. Field of the Invention

The present invention relates to a coaxial cable connector and, more particularly, to the disposition of an elastically deformable gasket within the connector body to provide a moisture seal when a cable is inserted into the connector.

2. Prior Art

There are many compression style coaxial cable connectors available for use outdoors which claim to be waterproof but, in fact, require that a number of factors to be perfect in order to realize this claim. Metal-to-metal tight seals require precision manufacturing to provide exact dimensions for fitting and sealing. When used in an outdoor application, the dimensions of adjacent parts of such precision connectors will change due to temperature fluctuations which can result in the failure of a moisture-proof seal. In addition, craft sensitivity factors such a proper insertion of the cable into the connector and proper adjustment of the compression tool to affect full compression are just some variables that can practically degrade performance.

In recent years, poor moisture ingress rejection has become a critical factor in the satellite market where DC current is passing through the coaxial connector along with RF signals. Low levels of moisture ingress into the connector may cause electrolytic corrosion with the DC present and result in unwanted electrical harmonic signals being generated. Accordingly, there is a continuing need for a coaxial cable connector for outdoor use which will impede the ingress of moisture into the connector under all climatic conditions to which the connector is exposed.

SUMMARY

The present invention is directed to an improvement in a compression-type coaxial cable connector that substantially obviates one or more of the limitations of the related art. To achieve these and other advantages and in accordance with the purpose of the invention, as embodied and broadly described herein, the invention includes an elastically deformable annular gasket disposed within the axial cavity within the connector body. When a cable is inserted into the axial cavity of the connector, the gasket deforms and seals the annular space between the cable jacket and the wall of the cavity to prevent moisture from passing the space sealed by the gasket.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION OF THE PREFERRED EMBODIMENTS

Artisans will appreciate that compression-type coaxial cable connectors are well known in the art. Artisans will appreciate that most such connectors include a tubular connector body having a leading end and a trailing end in opposition thereto with a cylindrical cavity ("axial conduit") in the trailing end thereof. A barbed shank is coaxially affixed to the connector body at the leading end thereof and projects rearwardly into the axial conduit. The leading end of the connector body has an adapter nut thereon that is operable for attaching the connector to a mating terminal. Such prior art connectors further include a compression sleeve slidingly mounted on the trailing end of the connector body. In operation, the prepared end of a coaxial cable is inserted through the compression sleeve and into the axial conduit. The cable is advanced until it cannot go further. The compression sleeve is then advanced over the connector body to force the connector body inwardly against the cable thereby completing the secure attachment of the connector to the cable. A disadvantage of such prior art connectors is that it is possible for moisture to enter the connector between the cable jacket and the connector body and corrode portions of the connector. The present invention is directed toward preventing ingress of such moisture by the inclusion of an elastically deformable gasket in the axial conduit in the connector body at the leading end thereof.

Figure 1:
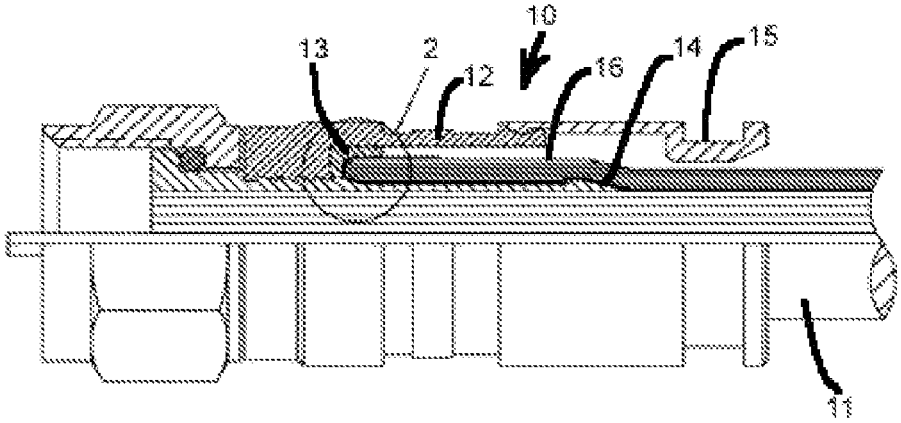
FIG. 1 is a partially cross-sectional view of a compression-type coaxial cable connector in accordance with the present invention illustrated with the cable fully inserted within the connector body and the gasket compressed to prevent moisture ingress between the cable, the barbed centerpost (shank) and the connector body prior to compression locking of the connector.

FIG. 1 is a partially cross-sectional view of a compression-type coaxial cable connector 10 in accordance with the present invention. In FIG. 1, the connector 10 is illustrated with the cable 11 fully inserted within the connector body 12 and the gasket 13 compressed to prevent moisture ingress between the cable 11, the barbed centerpost (shank) 14 and the connector body 12 prior to compression locking of the connector 10 to the cable 11. The connector 10 includes a compression sleeve 15 slidably mounted over the trailing end of the connector body 12. The gasket 13 is an annular member having a rectangular cross-section and made from an elastically deformable material such as silicone elastomer. The connector 10 is similar to prior art connectors except that gasket 13 is disposed in the axial conduit 16 of the connector body 12 at the leading end thereof. When the leading edge of the cable 11 is inserted into axial conduit 16 and advanced thereinto, the leading edge of the cable 11 presses against the gasket 13, compressing and deforming the gasket 13 to fill the annular space between the cable and the connector body thereby sealing the space and preventing moisture from passing through the space.

Figure 2:
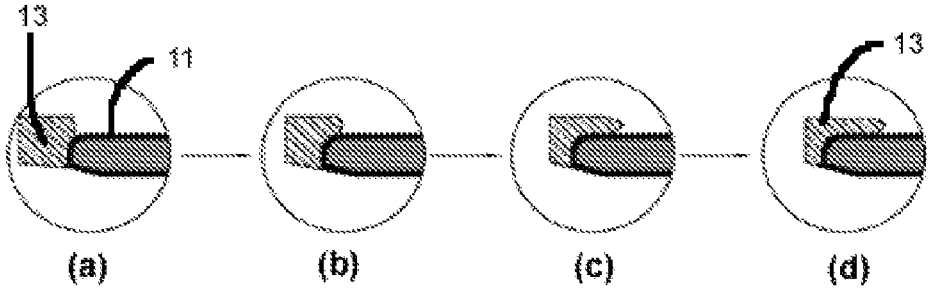
FIGS. 2*a*-2*d* are enlarged views of the gasket housed within the axial conduit in the connector body of the connector of the present invention, showing the gasket undergoing progressive compression and deformation as the cable is advanced into the axial conduit in the connector body, the shape of the gasket after full insertion of the cable being illustrated at FIG. 2*d*.
Figure 3:
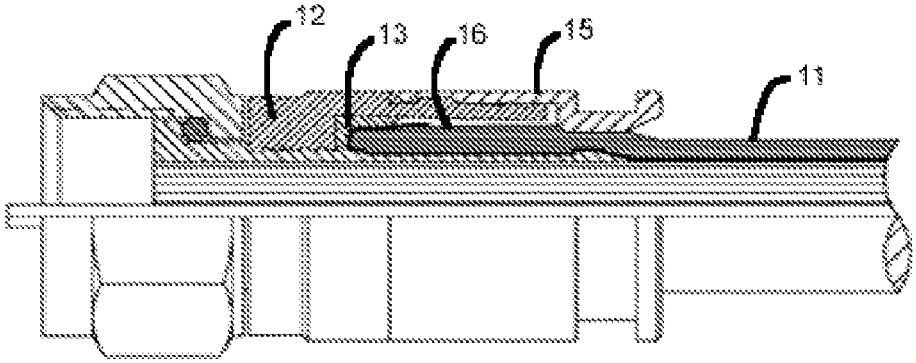
FIG. 3 is a partially cross-sectional view of a compression-type coaxial cable connector in accordance with FIG. 1 wherein the cable is fully inserted within the connector body and wherein the compression sleeve is fully advanced over the connector body and is in locking engagement therewith.

The progressive compression of the gasket 13 due to pressure exerted thereon by the leading end of cable 11 is shown in enlarged view in FIG. 2. FIG. 2(*a*) shows the cross-section of the gasket when the leading end of the cable makes contact with the gasket. FIG. 2(*b*) shows the compression and deformation of the gasket beginning. FIG. 2(*c*) shows the compression and deformation becoming more extreme as continued force on the cable is exerted; and FIG. 2(*d*) shows the conformation of the gasket when the cable is fully inserted into the axial conduit in the connector body. After the cable is fully inserted such that the gasket 13 seals the annular space between the cable and the wall of the axial conduit, the compression sleeve 15 is advanced over the connector body by means of a compression tool (not shown) in a manner well known in the art. FIG. 3 is a partially cross-sectional view of the compression-type coaxial cable connector in accordance with FIG. 1 wherein the cable is fully inserted within the connector body and wherein the compression sleeve is fully advanced over the connector body and is in locking engagement therewith.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. In a compression-type coaxial cable connector comprising a tubular connector body having a leading end, a trailing end and a cylindrical cavity in the trailing end thereof; a barbed shank coaxially affixed to the connector body at the leading end thereof and projecting rearwardly into the cylindrical cavity; an adapter nut attached to the leading end of the connector body operable for attaching the connector to a mating terminal; and a compression sleeve slidingly mounted on the trailing end of the connector body; the improvement comprising an elastically deformable gasket disposed within said cylindrical cavity.

2. The improvement as in claim 1 wherein said gasket is disposed in said leading end of said cylindrical cavity.

3. The improvement as in claim 2 wherein said gasket is constructed of an elastically deformable material.

4. The improvement as in claim 3 wherein said gasket has a rectangular cross section.

5. The improvement as in claim 3 wherein said elastically deformable material is a silicone elastomer.

6. The improvement as in claim 5 wherein said gasket has a rectangular cross section.

* * * * *